US007356872B2

(12) United States Patent
Jones et al.

(10) Patent No.: US 7,356,872 B2
(45) Date of Patent: Apr. 15, 2008

(54) AUTOMATED ELECTRONIC VACUUM SYSTEM AND METHOD

(75) Inventors: Terry G. Jones, Austin, TX (US); James M. Warren, Austin, TX (US); Christian Gerard, Austin, TX (US); Philip Leveridge, Austin, TX (US); Hoyet H. Andrews, III, San Antonio, TX (US); Jeffrey J. Spurgat, Madison, WI (US)

(73) Assignee: CrowleyJones, L.P., Austin, TX (US)

( * ) Notice: Subject to any disclaimer, the term of this patent is extended or adjusted under 35 U.S.C. 154(b) by 471 days.

(21) Appl. No.: 10/389,162

(22) Filed: Mar. 14, 2003

(65) Prior Publication Data

US 2004/0177467 A1 Sep. 16, 2004

(51) Int. Cl.
*A47L 5/38* (2006.01)

(52) U.S. Cl. ..... 15/319; 15/310

(58) Field of Classification Search ..... 15/319, 15/310, 301; *A47L 5/38*
See application file for complete search history.

(56) References Cited

U.S. PATENT DOCUMENTS

| | | | | |
|---|---|---|---|---|
| 548,721 | A | 10/1895 | Opdyke | |
| 5,083,704 | A * | 1/1992 | Rounthwaite | 15/319 |
| 5,205,013 | A * | 4/1993 | Lopes | 15/310 |
| 5,323,483 | A | 6/1994 | Baeg | |
| 5,353,468 | A | 10/1994 | Yap et al. | |
| 5,408,721 | A | 4/1995 | Wall et al. | |
| 5,560,077 | A | 10/1996 | Crotchett | |
| 5,655,253 | A * | 8/1997 | Nevin et al. | 15/310 |
| 5,829,090 | A | 11/1998 | Melito et al. | |
| 5,953,788 | A | 9/1999 | Douglas | |
| 6,285,017 | B1 | 9/2001 | Brickell | |
| 6,286,177 | B1 | 9/2001 | Robinson | |
| 6,292,977 | B1 | 9/2001 | Mantyla et al. | |
| 6,317,920 | B1 | 11/2001 | Brickner et al. | |
| 6,526,622 | B2 | 3/2003 | Conrad | |
| 6,530,114 | B2 | 3/2003 | Bailey et al. | |
| 6,671,924 | B1 * | 1/2004 | Rood | 15/310 |

FOREIGN PATENT DOCUMENTS

| | | | |
|---|---|---|---|
| CA | 2105554 | * | 3/1995 |
| GB | 2361862 | | 11/2001 |
| JP | 2001-16169 | * | 6/2001 |

* cited by examiner

*Primary Examiner*—Theresa T. Snider
(74) *Attorney, Agent, or Firm*—The Law Firm of H. Dale Langley, Jr. P.C.

(57) ABSTRACT

A vacuum device has a housing. The housing forms an inlet opening and an outlet opening. The housing also forms a viewable compartment for retaining refuse vacuumed by the device. A vacuum motor is located in the housing. The vacuum motor has a suction inlet and a vent outlet. The suction inlet is connected to the viewable compartment. The suction inlet is also connected to the inlet opening of the housing. The vent outlet of the vacuum motor is to the outlet opening of the housing. An electric circuit of the device is connected to the vacuum motor. The electric circuit is connected to a sensor and includes a microcontroller. The sensor, for example, an infrared beam and detector, triggers the electric circuit, and programmed control by the microcontroller, when the beam is broken and not detected by the detector. When the beam is broken, the sensor signals the microcontroller and the microcontroller logically powers-on the vacuum motor to suction the refuse into the housing.

10 Claims, 6 Drawing Sheets

Controller Logic

| Inputs | Motor (Vacuum Blower) Conditions |
|---|---|
| State 1:<br>Mode: Off<br>Button: Off<br>Sensor: Off | Off |
| State 2:<br>Mode: On<br>Button: Off<br>Sensor: Off | On |
| State 4:<br>Mode: Auto<br>Button: Off<br>Sensor: On | On only for time interval during which sensor detects motion (and any lagging interval after motion finally detected, if any) |
| State 5:<br>Mode: Auto<br>Button: On<br>Sensor: On | On for period that "Button" is on, then Off; except that On for time interval during which sensor detects motion (and any lagging interval, if any) notwithstanding "Button" activation |

FIGURE 3

AUTOMATED ELECTRONIC VACUUM SYSTEM AND METHOD

BACKGROUND OF THE INVENTION

The present invention generally relates to electronic vacuum devices and, more particularly, relates to vacuum cleaners having sensor-triggered, automated operations.

For many years, cleaning implements—e.g., brooms, rags, dusters—have not significantly changed. In fact, the basic tools for cleaning houses, offices, and other indoor and outdoor areas were long ago designed and commercialized. Over the last several decades, electronically operated cleaning devices have been invented. For example, electrically driven vacuum cleaners, and the like, have been known for a good number of years. Certain improvements and added features have been designed for these devices, but the basic concepts of the conventional cleaning devices remain as long ago conceived.

Over the last several decades, the various new improvements and added features for cleaning tools have typically regarded improved chemical and solvent-type formulas, better absorption and gathering cloths and other materials, and further automation of existing cleaning implements. With even these improvements and additions, however, manpower is nevertheless typically required to operate the tools and perform cleaning activities. Only recently, an objective of further automation in vacuum-equipped cleaning devices has been to limit the manpower required in cleaning processes.

For example, the recently newly available ROOMBA™ vacuum cleaner attempts to reduce the manpower required for performing vacuum cleaning. This vacuum cleaner unit includes drive motors and features to enable the vacuum device to automatedly traverse a surface and concurrently vacuum the surface. Notwithstanding nuances of the ROOMBA™ product, reducing manpower and human involvement has not usually been the primary focus of development of new cleaning tools. Rather, new development efforts for cleaning tools have largely focused on improved chemicals and materials, and automated cleaning—but not substantial elimination of manpower in cleaning operations.

Conventionally, sweeping as a cleaning process has required a human to handle a broom and dustpan. The human manually sweeps with the broom to collect refuse strewn over an entire surface. The collected refuse is manually gathered, including by sweeping with the broom, into the dustpan. The refuse swept into the dustpan is then manually carried and disposed in a separate location, such as in a trash repository or can. The manual collection and gathering typically requires the human to twist, lean, bend-over, and otherwise make somewhat tortuous body movements and bends.

It would be a significant improvement in the art and technology to further automate cleaning processes, such as certain of the manual efforts required for sweeping, collecting, gathering, and disposing of refuse via broom and dustpan. Additionally, it would be such an improvement to particularly automate those efforts that normally require the greatest manpower and most significant bodily capabilities and efforts. Moreover, it would be a significant improvement in the art and technology to provide simplified steps and procedures for such automated cleaning processes, particularly, including desirable switching among and between various levels or modes of manual involvement in the processes and of automated capabilities, performance, and options. The present invention provides numerous advantages and improvements, including, for example, automation of certain cleaning processes, reduced manpower requirements in such processes, and additional capabilities and modes for performing the processes.

SUMMARY OF THE INVENTION

An embodiment of the invention is a system for vacuum cleaning. The system includes a housing, having an inlet and an outlet. The system also includes a vacuum motor connected to the inlet and the outlet of the housing. A controller, connected to the vacuum motor, selectively controls the vacuum motor in response to an event.

Another embodiment of the invention is a vacuum device. The vacuum device includes a housing having an inlet opening and an outlet opening. The housing also includes a viewable compartment formed by the housing. The vacuum device includes a vacuum motor. The vacuum motor has a suction inlet and a vent outlet, each connected to the viewable compartment. The suction inlet is connected to the inlet opening of the housing, and the vent outlet is connected to the outlet opening of the housing. An electric circuit is connected to the vacuum motor. The circuit is connected to a sensor. The sensor detects an external event and signals a microcontroller connected to the circuit and the sensor.

Yet another embodiment of the invention is a vacuum controller. The controller includes a three-position switch, a two-position switch, a light sensor, and a circuit connected to the three-position switch, the two-position switch, and the light sensor. The circuit logic, together with states of the three-position switch, the two-position switch, and the light sensor, control vacuum operations.

Another embodiment of the invention is a method of automated operation of a vacuum device. The method includes sensing an external event to the vacuum device and controlling power-on of the vacuum device based on the step of sensing.

Yet another embodiment of the invention is a method of collecting swept refuse. The method includes positioning the refuse near a vacuum device, powering on the vacuum device, and sucking the refuse into the vacuum device.

Another embodiment of the invention is a circuit for aiding alignment of a sensor to a beam. The circuit includes a viewable LED electrically connected to the sensor. The viewable LED increases in brightness as the sensor becomes more accurately aligned with the beam.

BRIEF DESCRIPTION OF THE DRAWINGS

The present invention is illustrated by way of example and not limitation in the accompanying figures, in which like references indicate similar elements, and in which:

FIG. 3 illustrates a circuit for automated control of a motor, useable in the system of FIGS. 1 and 2, according to certain embodiments of the invention;

DETAILED DESCRIPTION

Figure 1:
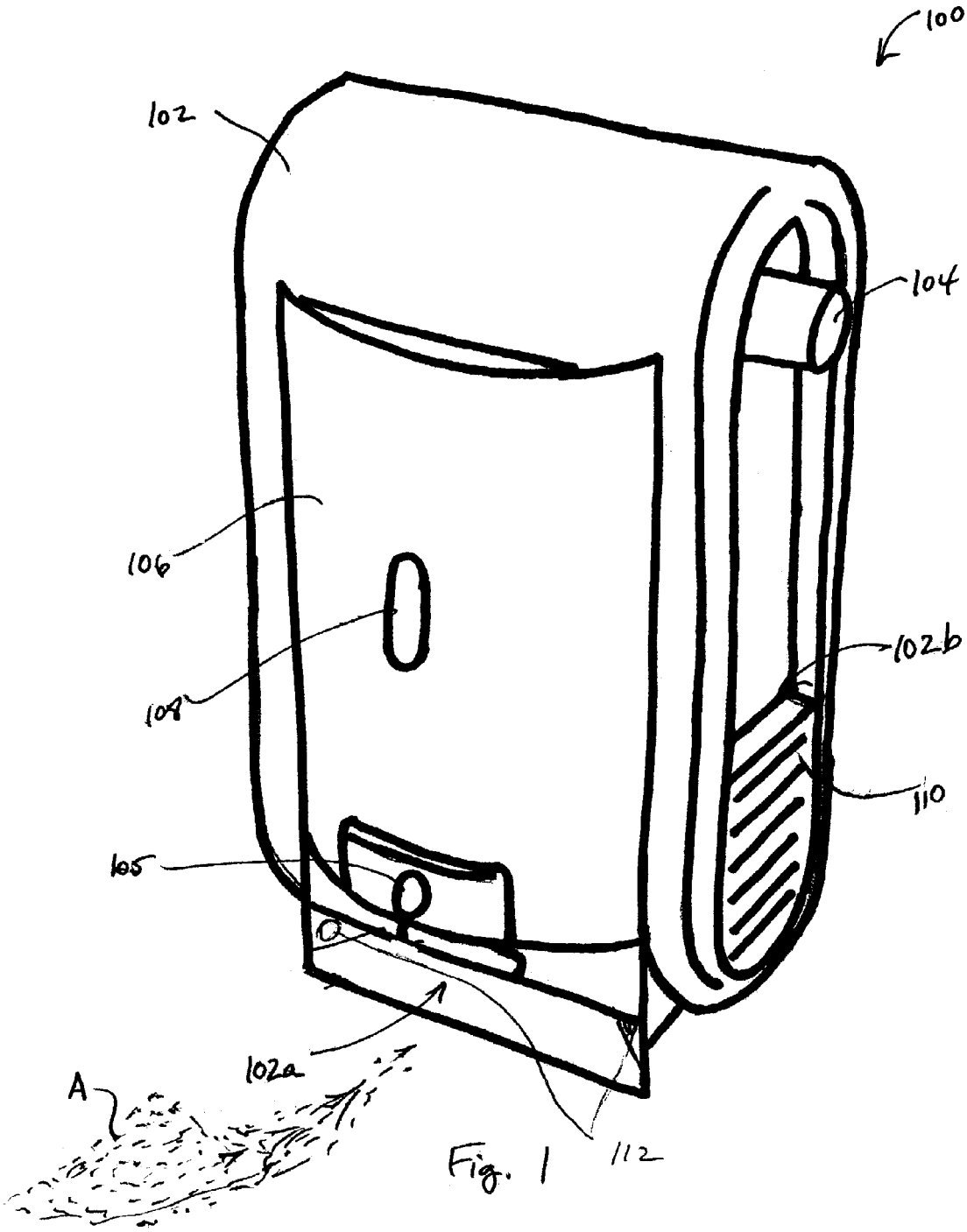
FIG. 1 illustrates a perspective view of a system for vacuum operations controllable by sensor-triggered features, according to certain embodiments of the invention.

Referring to FIG. 1, a system 100 for vacuum cleaning includes a housing 102. The housing 102 encloses a vacuum blower (not shown in detail in FIG. 1) and related electrical components (also not shown in detail in FIG. 1). The vacuum blower is electrically powered and controlled, is of a type sufficiently sized to fit within the housing 102, and provides adequate vacuum suction capability to pull into the housing 102 various refuse (exemplified by "A" in FIG. 1) located near the housing. An inlet 102*a* of the housing is located at a base of the housing 102. The inlet 102*a* serves as intake to the vacuum blower. When the vacuum blower of the system 100 is powered on, via operations of the electrical components, refuse (A) (e.g., such as, for example, swept dirt, dust, hairs and other contaminant matter) is vacuum sucked into the housing 102 at and through the inlet 102*a*.

The housing 102 stands vertically upright, and fits in a corner or other inconspicuous location on a floor or other flat surface in a room or other location. The housing 102 is, for example, on the order of 1-2 feet tall, 6-12 inches wide and 6-10 inches deep, although any of a wide variety of other dimensions and configuration of the housing 102 is possible according to desired application, location, and use. The housing 102 is formed of molded plastic or hard rubber, or other suitably stable and firm materials.

The housing 102 encloses various electrical and optical elements as herein after described. Additionally, the housing 102 provides certain control features for the system 100. For example, a rotatable Man/Off/Auto selector dial 104 extends from within the housing 102 and permits manual selection of the dial 104 by a human user of the system 100. The dial 104 permits manual designation of the system 100 mode (e.g., on, off or automatic), by a human user. At a lower portion of the housing 102, a pushable manual activation button 105 powers on or off the vacuum blower of the system 100.

Additionally, the housing 102 includes a tiltable hinged canister compartment 106. The compartment 106 is hingedly connected at a lower portion of the housing 102 and snaps upright to close the housing 102. Within the compartment is included a canister, sack, bag or other container (not shown in detail in FIG. 1) for retaining collected refuse within the housing 102. The housing 102 also includes a somewhat transparent window 108 formed in a side of the compartment 106, for viewing a level of refuse retained in the container within the compartment 106. The compartment 106, when hingedly swung down from the upright closed position of the housing 102, reveals the container with refuse (e.g., for emptying, changing, removal and so forth).

The housing 102 also provides guided locators for fitting one or more filters 110 in the system 100. The filters 110 are locatable at an outlet vent 102*b* portion of the housing 102, for outlet venting of the vacuum blower (not shown in detail) of the system 100 contained within the housing 102. The filters 108 are, for example, standard HEPA-type filters, and prevent escape of refuse sucked into the housing 102, via the vacuum blower at the inlet 102*a*, from escaping from the housing 102, via the outlet venting of the vacuum blower at the outlet 102*b*.

Another feature of the housing 102, a motion sensor 112, is included as part of the housing 102 adjacent the inlet 102*a* of the housing 102. The sensor 112 is electrically connected to and is part of the electronic components (not shown in detail in FIG. 1) of the system 100. The sensor 112 electrically controls operations of the vacuum blower of the system 100, whenever the sensor 112 detects a triggering event, such as motion at or near the sensor 112 or lack of motion thereat. The sensor 112 is itself electrically operated and is, for example, optically equipped for activation upon sensing movement.

In operation of the system 100, the system 100 is "Off" and is not supplied with electrical power whenever the dial 104 is rotated to the "Off" position. When the system 100 is "Off", in this manner, the vacuum blower and other electrical components of the system are inoperable. If the dial 104 is rotated to the "Man" position, however, electrical power supplies the system 100. Then, the vacuum blower and other electrical components of the system are operable "on" and "off" by the manual activation button 105. The button 105 is pressed on/off by a human user of the system 100.

The usual operating mode of the system 100 is "Auto". The system 100 is in this "Auto" mode whenever the dial 104 is rotated to the "Auto" position. In this "Auto" mode (i.e., dictated by the dial 104 position), the system 100 powers on and off the vacuum blower based on detections of the sensor 112. The sensor 112 and related electrical components of the system 100 remain operational whenever the system 100 is in this "Auto" mode. Any motion optically detected by the sensor 112 triggers the electrical components of the system 100 to power on the vacuum blower of the system 100. When so powered on, the vacuum blower suctions air and refuse (A) into the inlet 102*a*. Refuse (A) passing into the inlet 102*a* is captured in the container of the compartment 106. Outlet air from the vacuum blower passes through the filters 110 at the outlet 102*b* of the housing 102, as the air (i.e., free of the refuse) vents from the housing 102.

When in "Auto" mode, the vacuum blower is powered on for a desired interval of time, for example, 5 seconds. The desired interval for power on is programmed in the system 100 via the electronic components. The desired interval can be selectively adjusted, as desired for the application, such as by maintaining the power on for the vacuum blower while any movement continues detected by the sensor 112, then followed by continued power on for a time interval after movement cease. Of course, many alternative possibilities for power on and other operations of the system 100 are possible, as those skilled in the art will know and understand. In every event, the system 100 is operable, either automatically or manually, to power on the vacuum blower whenever desired for suction cleaning of refuse.

Figure 2:
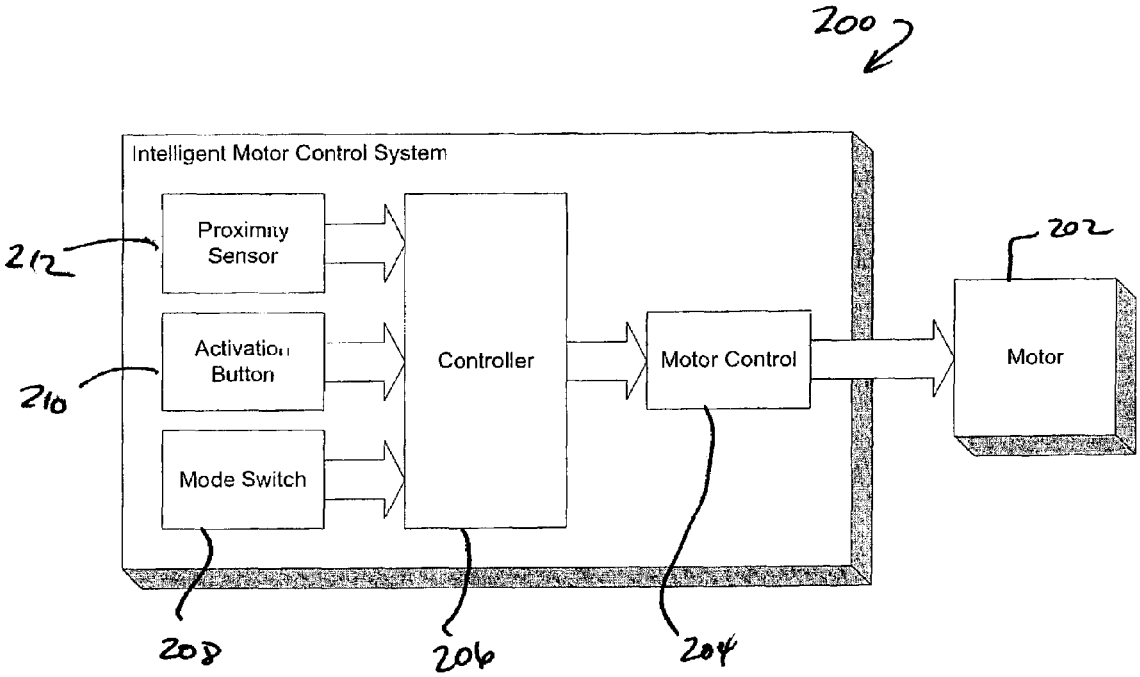
FIG. 2 illustrates a system for automated control of a motor, such as an electrical vacuum blower motor in a vacuum device, according to certain embodiments of the invention.

Referring to FIG. 2, a controller 200 of the system 100 (shown in FIG. 1) controls operations of a motor 202, such as the vacuum blower of the system 100. The controller 200 is contained within the housing 102 (shown in FIG. 1) of the system 100. Of course, the vacuum blower of the system 100 is one type of the motor 202 controllable by the controller 200.

The controller 200 is electrically or otherwise operationally connected to the motor 202 (e.g., the vacuum blower of the system 100). A motor control 204 of the controller 200 is connected to the motor 202. The motor control 204 serves for switching the power (and also possibly mode) on and off to the motor 202. Additionally or alternatively, the motor control 204 can serve to switch extent of power to the motor 202, for example, if the motor 202 is operable at variable speeds or in other varied manners. Certain specifics of the motor control 204 will depend upon the desired and inherent functionalities of the motor 202 and the control thereof by the motor control 204, as those skilled in the art will know and understand. In every event, however, the motor control 204 provides direct physical control of the motor 202 operations and interfaces to a logical controller 206 (hereafter described) for logical operations of the motor 202 through the interface.

The logical controller 206 of the controller 200 is connected to the motor control 204. The logical controller 206 is connected to three inputs: a switch 208, a button 210, and a sensor 212. The switch 208 is, for example, an electrical or other control signal directed by and corresponding to rotatable positioning of the dial 104 of the housing 102 of the system 100 (shown in FIG. 1). Thus, the switch 208 is input to the controller 206 corresponding to the dial 104 position for the mode of the system 100, e.g., either "Off", "On", or "Auto". The button 210 is, for example, a manual or external input (such as a human user's input) to the power on operations of the vacuum blower of the system 100, e.g., either "on" or "off" operation of the vacuum blower via a human user pressing of the manual button 105 of the system 100. The button 210 is, therefore, a signal input to the controller 206 because of manual control by a user. Finally, the sensor 212 is a signal input to the power on operations of the vacuum blower of the system, triggered by a particular event, such as detection of movement adjacent a sensing element like the sensor 112 of the system 100. The sensor 212 signals to the controller 206 that the particular event either is or is not occurring, for purposes of logical control of the motor control 204 by the controller 206.

Referring to FIG. 3, various states 300 for the logical operations by the logical controller 206 are shown in the table. In effect, the logical controller 206, based on the inputs of the switch 208, the button 210, and the sensor 212, dictates the operations of the motor control 204 to physically control the motor 202 either on or off. As listed in the table of FIG. 3, the motor 202 (e.g., the vacuum blower of the system 100 of FIG. 1) is "On", if and when either: (i) the Mode is set to On via manual input by a human user; or (ii) the Sensor is set to On by detection of an event (such as movement) when the Mode is set to Auto via manual input by a human user. In other states, the motor 202 is controlled off (e.g., is not supplied with power) via the logic of the controller 206 and its handling of the motor 202 through the motor control 204.

Figure 4:
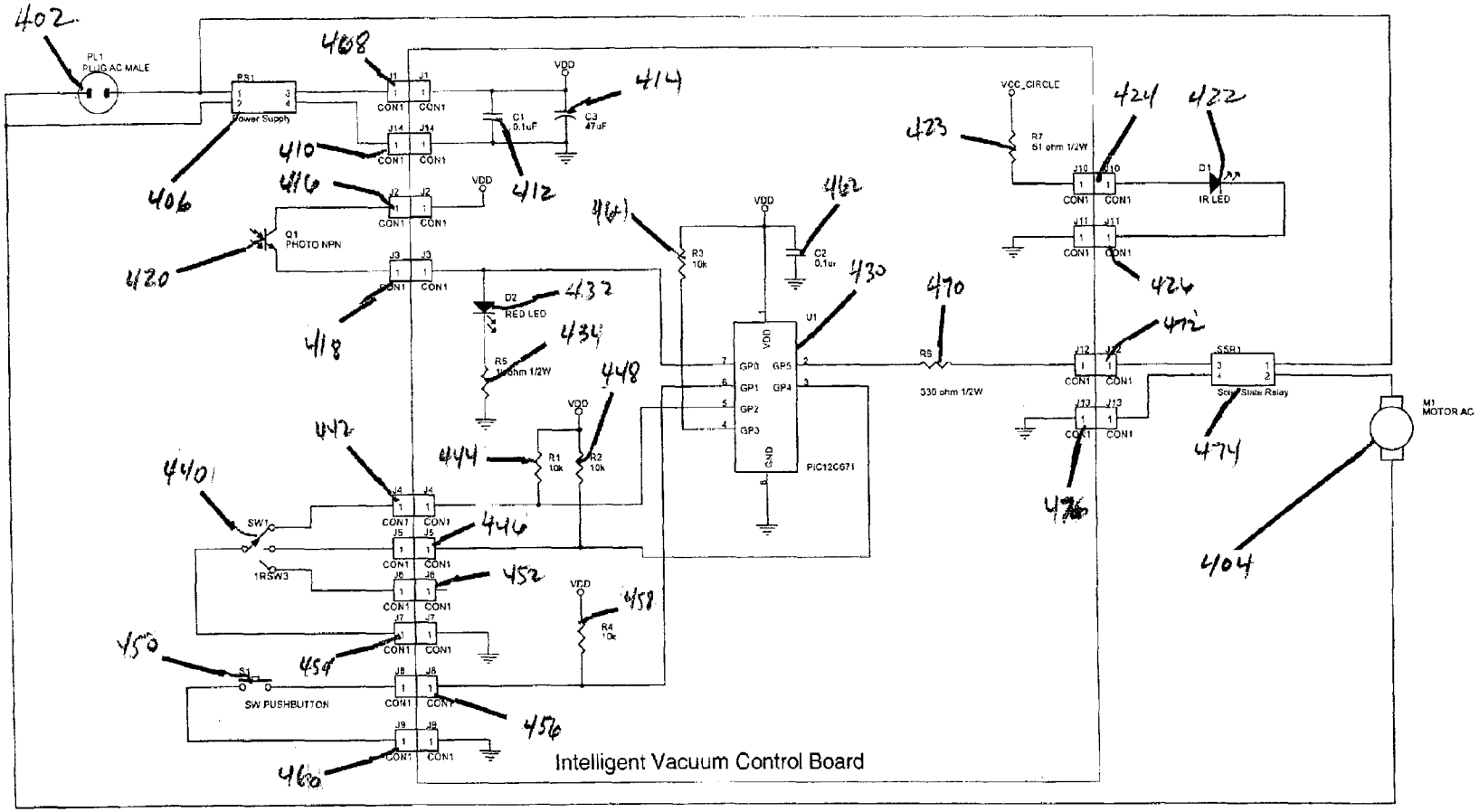
FIG. 4 illustrates states of operability for a motor, such as a vacuum blower motor in the system of FIGS. 1 and 2, according to certain embodiments of the invention.

Referring to FIG. 4, a circuit 400 performs the functions of the controller 200 of FIG. 2. The circuit 400 is implemented in the system 100 (shown in FIG. 1) for operating and controlling the system 100. The circuit 400 implemented in the system 100 is, for example, a circuit board and electrical connections and components contained within the housing 102 of the system 100. The circuit 400 includes and is electrically connected to and between a power source 402 and a vacuum blower motor 404.

The power source 402 is AC electrical power, such as provided via an AC plug in a wall electrical jack. The power source 402 electrically connects to a power supply 406. The power supply 406, for example, converts the AC electrical power of the power source 402 to a current and voltage suitable for the circuit 400, such as 5 Volts DC. The power supply 406 connects to connectors 408, 410.

Each of the connectors is electrically connected to first and second capacitors 412, 414, in parallel. Particularly, connector 408 is connected to a lead of a first capacitor 412. The first capacitor is, for example, a 0.1 μF capacitor. The connector 408 is also commonly connected to a lead of a second capacitor 414, which is also connected to a voltage source $V_{DD}$. The second capacitor is, for example, a 47 μF capacitor. The other lead of each of the first and second capacitors 412, 414 is connected to the connector 410, and commonly connected to ground.

A photosensor 420, for example, a photovoltaic npn transistor, is electrically connected across connectors 416, 418. The photosensor 420 is physically coupled (in line-of-sight relationship in the housing 102 at the inlet 102*a* of the system 100) with an infrared (IR) LED 422 of the circuit 400, to act as a motion (i.e., proximity) sensor in the system 100. Connector 416 connects to the voltage source $V_{DD}$. The voltage source $V_{DD}$ is also connected to a resistor 423, for example, a 51Ω ½W resistor. The resistor 423 connects to a connector 424, which connects to a lead of the IR LED 422. Another lead of the IR LED 422 is connected to a connector 426, also connected to ground. In operations, whenever an infrared beam passing from the IR LED 422 to the photosensor 420 is interrupted (e.g., whenever refuse or a broom straw break the beam), the resistor 423 pulls down to ground. This signals a microcontroller (i.e., logic chip) 430 connected to the connector 418 from the photosensor 420 (The signaling corresponds to an On state of the Sensor input to the controller 206 of FIG. 2 and of the states listed in FIG. 3).

The connector 418 is also connected to a red LED 432 (or other visible light LED). The LED 432 is also connected to a resistor 434, such as a 1 kΩ ½W resistor, that is connected to ground. The LED 432 is included for purposes of manufacturing of the system 100 for vacuum operations. The LED 432 is positioned and connected so that, when the IR LED 306 is aligned with the photosensor 420 across the inlet 102*a* of the housing 102 of the system 100, the LED 432 lights up indicating proper alignment. This allows quick and simple determination of physical alignment of the infrared beam between the IR LED 306 and the photosensor 402 in the housing 102*a*.

The microcontroller 430 additionally is connected to receive signals of three-position switch 440 and a pushbutton switch 450. (The three-position switch 440 signals the microcontroller 430 corresponding to the Mode input to the controller 206 of FIG. 2 and of the states listed in FIG. 3). In the system 100, the three-position switch 440 corresponds to the dial 104 of the housing 102 of the system 100. The three-position switch 440 connects to a connector 442 of the circuit 400. The connector 442 connects to a resistor 444, for example, 10 kΩ, and which is also connected to the microcontroller 430. The voltage source $V_{DD}$ connects to the other lead of the resistor 444. Whenever the three-position switch 440 completes the circuit through the connector 442, the connection to the microcontroller 430 signals for logic of "Auto" control by the microcontroller 430. In this "Auto" control mode, the photosensor 420 and IR LED 422 combination controls the on and off of the motor 404.

A second position for the three-position switch 440 completes the circuit through a connector 446. The connector 446 is connected to a resistor 448, such as 10 kΩ, and commonly connected to the microcontroller 430 as an input thereto. Another lead of the resistor 448 is connected to the voltage source $V_{DD}$. Whenever the three-position switch 440 completes the circuit through the connector 446, the connection to the microcontroller 430 signals for logic of "Man" control by the microcontroller 430. In this "Man" control mode, the microcontroller controls the motor 404 in power on state.

A third position of the three-position switch 440 completes the circuit through a connector 452. The connector 452 is a break in the circuit. In this position for the three-position switch 440, there is not any signal from the switch 440 to the microcontroller 430. This position corresponds to the "Off" control mode, and the motor 404 and entire circuit 400 are powered off in the system 100.

In each instance, the switch 440 is also connected to a connector 454 that is connected to ground.

Another connection to the microcontroller 430 is made by a pushbutton switch 450 of the circuit 400. When the switch 450 is pushed-in (or out, as the case may be for the switch operability), the circuit is completed through a connector 456. The connector 456 is connected to a resistor 458 and to the microcontroller 430. The resistor 458 is, for example, a 10 kΩ resistor with another lead connected to the voltage source $V_{DD}$. The pushbutton switch is also connected, via connector 460, to ground. Whenever the pushbutton switch 450 is switched to complete the circuit through the connector 456, the connection to the microcontroller 430 signals for manual "Man" control by the microcontroller 430. In this "Man" control mode, the microcontroller controls the motor 404 in power on state.

The microcontroller 430 is further connected to the voltage source $V_{DD}$ and a capacitor 462. The capacitor 462 and the voltage source $V_{DD}$ power the microcontroller and connect across a resistor 464 thereto. The capacitor 462 is, for example, 0.1 μF capacitor, and the resistor 464 is, for example, a 10 kΩ resistor.

The microcontroller 430 additionally connects to a resistor 470, such as 330Ω½W resistor. Another lead of the resistor 470 connects to a connector 472, connected to a solid state relay 474. The relay 474 is connected to the input power source to the circuit 400 and to the motor 404. The motor is connected to the power supply 406. Another connector 476 connects the relay 474 to ground.

In generalities, the microcontroller 430, in operation in the circuit 400, receives inputs governed by the three-position switch 440 as "Mode" determinants. The resistors 444 and 448 serve as pull ups to power for the "Auto" and "Man" modes of the switch 440. The pushbutton switch 450 is a manual activation button for "on" and "off" operations, notwithstanding the mode (other than "Off") of the switch 440. The resistor 458 pulls up to power for "on" operations of the switch 450. The microcontroller 430 is operated by software (as hereinafter further detailed) and receives settings and states of the photosensor 420 and IR LED 422 combination, the three-position switch 440, and the pushbutton switch 450. Via the software logic programmed for the microcontroller 430, the microcontroller 430 controls operations of the motor 404 through the solid state relay 474. The relay 474 interfaces between the microcontroller 430 and the physical requirements of the motor 404 (effectively serving as the motor control 204 of FIG. 2).

Figure 5:
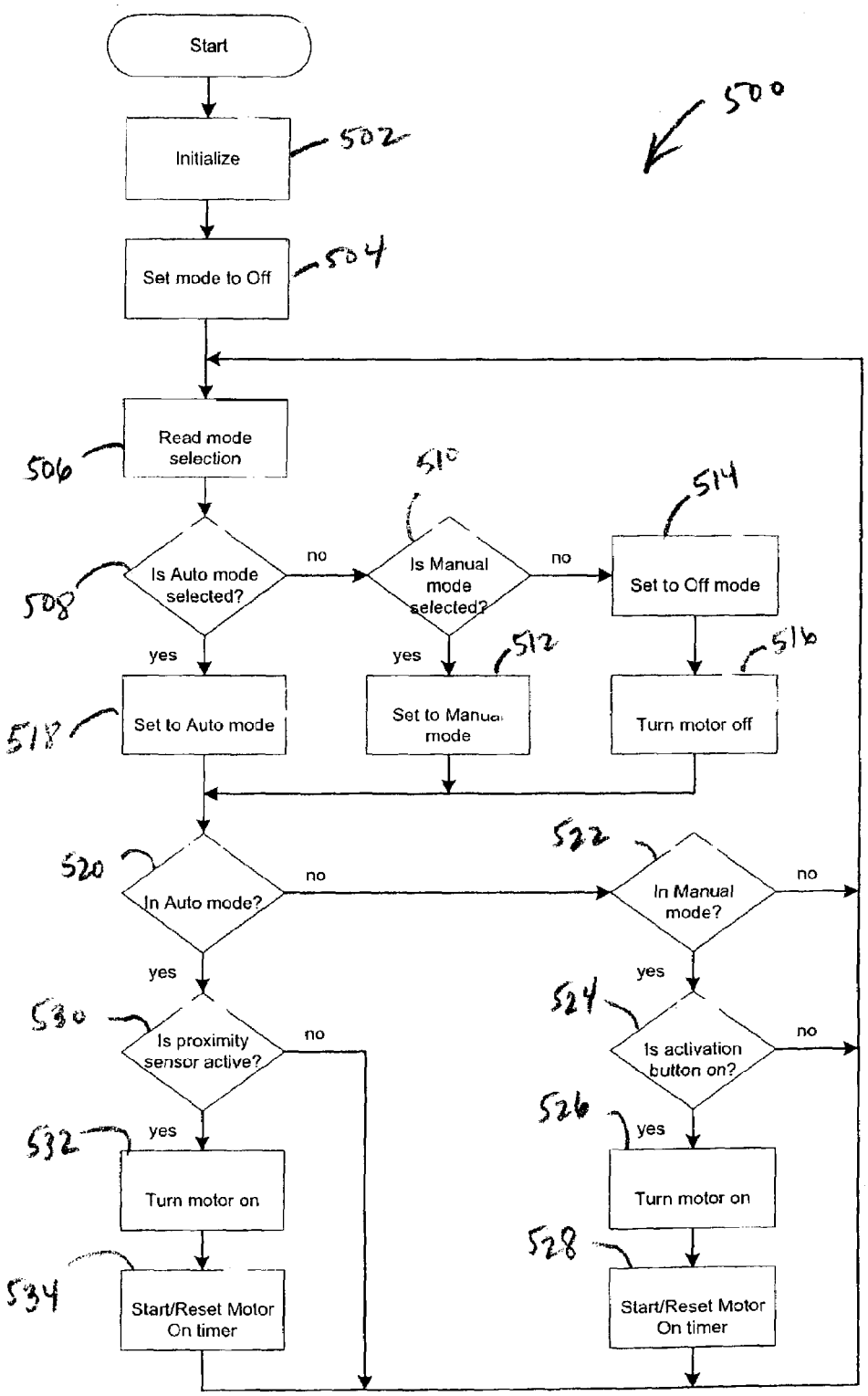
FIG. 5 illustrates a method for automated control of a motor on start-up operations, according to certain embodiments of the invention.

Referring to FIG. 5, a method 500 operates the circuit 400 of FIG. 4, in use, for example, in operations of the system 100 of FIG. 1 and according to the controller 200 of FIG. 2 and the states listed in FIG. 3. The method 500 commences with a power on to the system 100. The power on to the system 100 begins a step 502 of initialization of the system 100. The initialization step 502 performs a power up of the circuit 400, the various electrical and optical components, and any system check or test operations.

After the intializing step 502, the "Mode" of operation of the system 100 is initially set to "Off" in the step 504. The "Off" Mode, as has been discussed above, corresponds to a system 100 state in which the dial 104 (and corresponding three-position switch 440 of the circuit 400) is set to "Off". This is the preliminary Mode for the system 100 on power up, until a next step 506 occurs.

After initial set in the step 504, the method 500 proceeds with a step 506 of reading the actual Mode as dictated by the physical rotated position of the dial 104 (i.e., three-position switch 440). In a step 508, a determination is made whether or not the "Auto" mode is selected based on the dial 104 position (i.e., corresponding to the position of the three-position switch 440). If the determination in step 508 is that the mode is other than "Auto", then the method 500 proceeds to a step 510.

In the step 510, it is determined if the mode for the system 100 is "Man" based on the dial 104 positions (i.e., and corresponding to the position of the three-position switch 440). If the step 510 determines that "Yes" the system 100 is in manual "Man" mode, then a step 512 sets the mode for the system 100 operations as manual "Man". This powers on the motor 404 (i.e., the vacuum blower) until a different mode is selected, as indicated by the arrow return to a step 520 in the method 500.

If the step 510 otherwise determines that "No" the system 100 is not in manual "Man" mode, the method 500 proceeds to a step 514. The step 514 sets the mode for the system 100 operations as manual "Off". This powers off the motor 404, in a step 516, and the system 100 remains off unless or until a different mode is selected (e.g., arrow return to the step 520).

If initially in the step 508 it is determined that the mode for the system 100 is "Auto", then a step 518 follows in which the system 100 mode is operated as "Auto".

Thereafter, the method 500 proceeds with determinations in the step 520 of whether the system 100 continues in "Auto" mode. If not, then a next 522 determines whether manual "Man" mode is selected. If not, then the method returns to the step 506. If manual "Man" mode is then selected, based on the determination in the step 522, a next step 524 determines if the manual pushbutton 105 of the system 100 (i.e., corresponding to the pushbutton switch 450 of the circuit 400) is on (closed circuit) or off (open circuit). If the step 524 determines the system 100 is on via the pushbutton 105, then the motor 404 is turned on in a step 526. The motor 404 thereafter remains powered on unless and until a step 528 turns off or resets the motor 404, for example, based on passage of time of operations or other characteristics. After the step 528, the method 500 returns to the step 506.

If, alternatively, the step 520 determines that "Auto" mode continues, then a step 530 continuously determines a state of the sensor 112 of the system 100 (i.e., corresponding to whether an IR light beam is or is not then interrupted between the IR LED 422 and the photosensor 420 of the circuit 400). If the state of the sensor 112 indicates that an event (e.g., interruption of the light beam) is not occurring, then the method 500 returns to the step 506. On the other hand, if the state of the sensor 112 indicates that the event (e.g., break of the light beam) is occurring, then a step 532 turns on the motor 404 (i.e., vacuum blower) of the system 100. Thereafter, a step 534 powers off or otherwise resets the motor 404 operations based on timing or duration of the power on period, time delay after the event concludes, or other similar event timing or duration passage (e.g., according to choice in implementation of the design).

Figure 6:
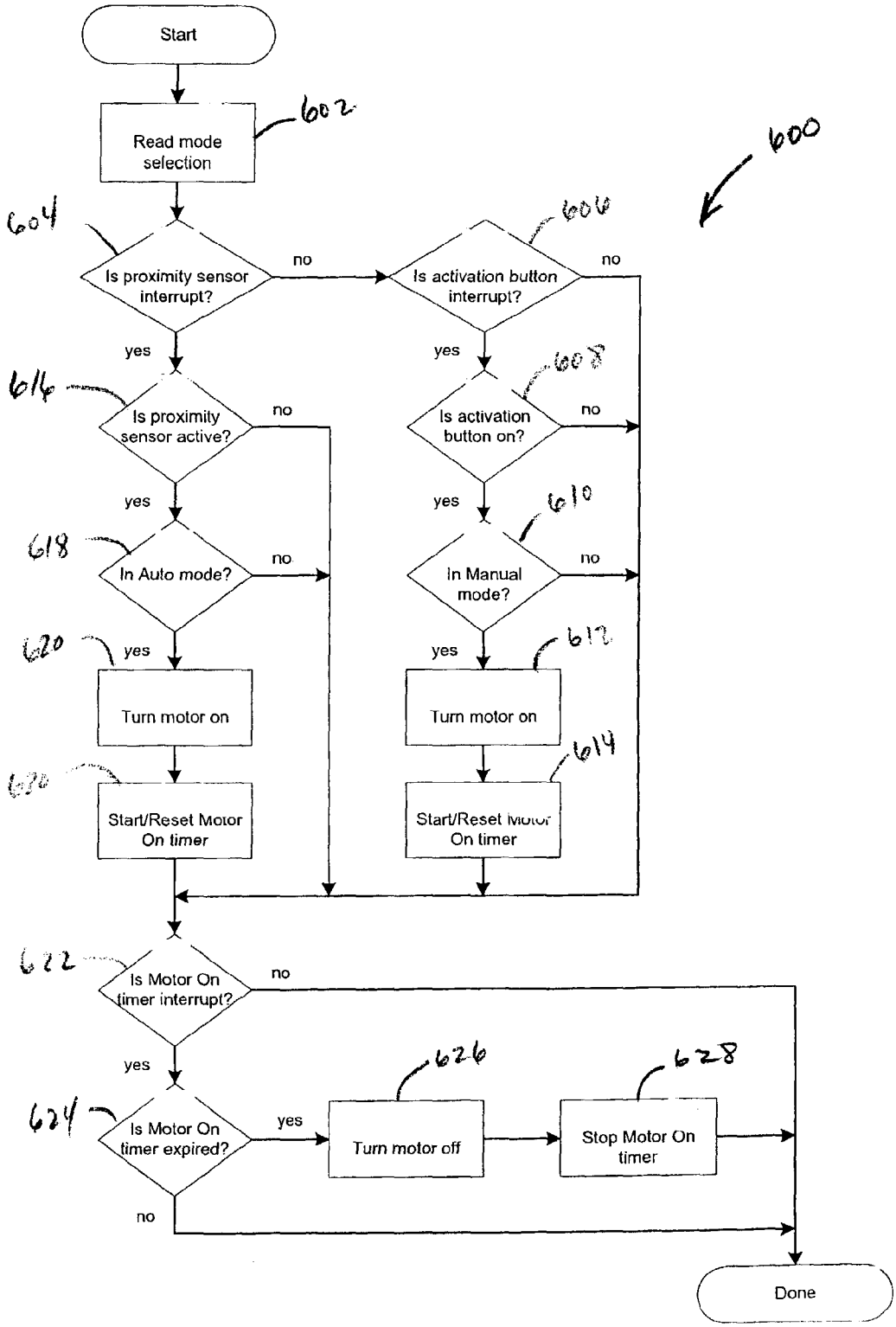
FIG. 6 illustrates a method for automated control of a motor in shut-down operations, according to certain embodiments of the invention.

Referring to FIG. 6, a method 600 is performed on interruption of the method 500. In such instance, the method 600 is performed by the circuit 400 of FIG. 4, in use, for example, in operations of the system 100 of FIG. 1 and according to the controller 200 of FIG. 2 and the states listed in FIG. 3. The method 600 is initiated with a step 602 of determining (i.e., "reading") the mode for operation of the system 100.

After the step 602, a determination is made in a step 604 whether an event (e.g., interruption of IR light beam) has been detected via the sensor 112 of the system 100. If not, the method 600 continues to a step 606. In the step 606, a determination is made whether the manual pushbutton 105 (i.e., the pushbutton switch 450 of the circuit 400) is then changed by user depression. If a change in the pushbutton 105 occurs, then a step 608 determines if the change is to "on" operations for the system 100. Otherwise, the method 600 proceeds to a step 622 (hereafter detailed).

If the change determined in the step 608 indicates "on" operations, a step 610 detects whether or not manual "Man" mode is then selected (e.g., via the dial 104 position, and corresponding three-position switch 440 position). If not, the method 600 proceeds to the step 622. If so, the motor 404 is powered on in a step 612 by the circuit 400. Thereafter, a step 614 powers off or resets the motor 404, according to the timing and duration settings for the system 100. After the step 614, the method 600 proceeds to the step 622.

On the other hand, if the step 604 detects the event occurrence via the sensor 112 (e.g., interruption of the IR light beam), then the method 600 proceeds to a step 616. In the step 616, the system 100 tests for whether the sensor 112 (i.e., particularly, the photosensor 420 and IR LED 422 combination of the circuit 400) are active and operating. If not, then the method 600 proceeds to the step 622. Otherwise, a next step 618 detects whether the system 100 is then operating in "Auto" mode. If not, the next step is step 622. If the system 100 is then operating in "Auto" mode, then a step 620 turns on the motor 404 (i.e., the vacuum blower of the system 100). Thereafter, a step 620 powers off or resets the motor 404, according to the timing and duration settings for the system 100 and controlled via the microcontroller 430 of the circuit 400.

In a step 622, following the step 620 and otherwise following the preceding steps of the method 600, the method 600 detects whether or not the timing of the power on for the motor 404 is interrupted. If not, then the method 600 concludes.

If the timing is interrupted, then the step 622 proceeds to a step 624. The step 624 determines whether or not the timing has expired for the power on of the motor 404 (e.g., according to the settings programmed for the system 100 for the power on timing or duration). If the timing has then expired, the motor 404 is powered off in a step 626 and, additionally or alternatively, a timing delay for the power off is performed in a step 628. Otherwise, or in any event at the completion of the step 628, the method 600 concludes.

At conclusion of the method 600, the system 100 is wholly off. Any next start-up of the system 100 proceeds according to the method 500 of FIG. 5.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems and any element(s) that may cause any benefit, advantage, or solution to occur or become more pronounced are not to be construed as a critical, required, or essential feature or element of any or all the claims. As used herein, the terms "comprises, "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system for vacuuming a refuse resident on a surface, wherein the system contacts and fits on the surface when in use for vacuuming, comprising:

a housing, having an inlet and an outlet, the inlet of the housing contacting the surface when the system is in use for vacuuming;

a vacuum motor connected to the inlet and the outlet of the housing;

a light source connected to the housing;

a light sensor connected to the housing for sensing the light source; and a controller, connected to the vacuum motor, for selectively controlling the vacuum motor in response to an event near the surface, the event including interruption of sensing of the light source by the light sensor.

2. The system of claim 1, wherein the event is external to the system outside the inlet.

3. The system of claim 1, wherein the controller powers on the vacuum motor whenever the event occurs.

4. The system of claim 1, wherein the controller powers on the vacuum motor whenever the event is detected via the light sensor.

5. A vacuum device for vacuuming refuse at a surface, comprising:

a housing, having an inlet opening and an outlet opening, the housing having a viewable compartment substantially formed integral to the housing, the housing fits on, and at the inlet opening contacts, the surface;

a vacuum motor, having a suction inlet and a vent outlet, each connected to the viewable compartment, and connected at the suction inlet to the inlet opening of the housing and connected at the vent outlet to the outlet opening of the housing;

an electric circuit connected to the vacuum motor;

a light connected to the circuit, fixed to the housing near the inlet opening;

a light sensor connected to the circuit, fixed to the housing near the inlet opening, operable responsive to detection of an external event interruption of sensing of the light by the sensor; and a microcontroller connected to the circuit and the sensor;

wherein the inlet opening contacts the surface for vacuuming from the surface when remaining substantially laterally stationary on the surface.

6. The vacuum device of claim 5, wherein the outlet opening includes supports for maintaining a filter at the vent outlet.

7. The vacuum device of claim 5, wherein the electric circuit includes switches for programming the microcontroller to selectively control the vacuum motor either on or off; and wherein the microcontroller is further programmed to selectively control the vacuum motor on, in response to detection of the external event by the sensor.

8. A method of automated operation of a vacuum device, comprising the steps of:

providing a light sensor to the vacuum device;

providing a light source to the vacuum device, the light source visible to the light sensor if not interrupted;

positioning the vacuum device on a surface to be vacuumed by the vacuum device;

sensing an external event to the vacuum device, the external event adjacent the surface for vacuuming by the vacuum device; and controlling power to the vacuum device, for vacuum operations by the vacuum device, based on the step of sensing.

9. The method of claim 8, wherein the step of sensing comprises the step of:

viewing an infrared beam of the light source by the light sensor, the infrared beam detected by the light sensor if not interrupted; and interfering with the infrared beam to interrupt the step of viewing as the external event.

10. The method of claim 8, further comprising the step of:

manually overriding the step of controlling.

* * * * *